US006946226B2

(12) United States Patent
Wu et al.

(10) Patent No.: US 6,946,226 B2
(45) Date of Patent: Sep. 20, 2005

(54) PHOTOCONDUCTIVE IMAGING MEMBERS

(75) Inventors: Jin Wu, Webster, NY (US); Yuhua Tong, Webster, NY (US); Liang-Bih Lin, Webster, NY (US); Nan-Xing Hu, Oakville (CA); Linda L. Ferrarese, Rochester, NY (US); James M. Duff, Mississauga (CA); Yu Qi, Oakville (CA)

(73) Assignee: Xerox Corporation, Stamford, CT (US)

( * ) Notice: Subject to any disclaimer, the term of this patent is extended or adjusted under 35 U.S.C. 154(b) by 70 days.

(21) Appl. No.: 10/647,055

(22) Filed: Aug. 22, 2003

(65) Prior Publication Data

US 2005/0042533 A1 Feb. 24, 2005

(51) Int. Cl.[7] ..... G03G 5/047

(52) U.S. Cl. ..... 430/64; 430/65; 430/58.25; 430/58.87; 430/59.4

(58) Field of Search ..... 430/64, 65, 58.25, 430/58.8, 59.4

(56) References Cited

U.S. PATENT DOCUMENTS

| | | | | |
|---|---|---|---|---|
| 4,921,769 | A | 5/1990 | Yuh et al. | 430/64 |
| 6,287,737 | B1 | 9/2001 | Ong et al. | 430/58.8 |
| 6,444,386 | B1 | 9/2002 | Liu et al. | 430/64 |
| 2004/0197686 | A1 * | 10/2004 | Belknap et al. | 430/58.8 |

OTHER PUBLICATIONS

Nancy L. Belknap et al, U.S. Appl. No. 10/408,201 on Photoconductive Imaging Members, filed Apr. 4, 2003.

Jin Wu et al., U.S. Appl. No. 10/369,816 on Photoconductive Imaging Members, filed Feb. 19, 2003.

* cited by examiner

*Primary Examiner*—Mark A. Chapman
(74) *Attorney, Agent, or Firm*—E. O. Palazzo

(57) ABSTRACT

A photoconductive imaging member comprised of a supporting substrate, a hole blocking layer thereover, a photogenerating layer, and a charge transport layer, and wherein the hole blocking layer is comprised of particles chemically attached on the surface of an electron transport component.

29 Claims, No Drawings

PHOTOCONDUCTIVE IMAGING MEMBERS

PENDING APPLICATIONS AND PATENTS

Illustrated in U.S. Ser. No. 10/408,201, filed Apr. 4, 2003 on Photoconductive Imaging Members, now U.S. Publication 2004/0197686, the disclosure of which is totally incorporated herein by reference, is a photoconductive imaging member comprised of a supporting substrate, a hole blocking layer thereover, a photogenerating layer, and a charge transport layer, and wherein the hole blocking layer is comprised of a metallic component and an electron transport component.

Illustrated in U.S. Ser. No. 10/369,816, filed Feb. 19, 2003 on Photoconductive Imaging Members, now U.S. Publication 2004/0161684, the disclosure of which is totally incorporated herein by reference, is a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Illustrated in U.S. Ser. No. 10/408,204, filed Apr. 4, 2003, entitled Imaging Members, now U.S. Publication 2004/0197685, the disclosure of which is totally incorporated herein by reference, is a photoconductive imaging member comprised of a supporting substrate, and thereover a single layer comprised of a mixture of a photogenerator component, charge transport components, and a certain electron transport component, and a certain polymer binder.

Illustrated in U.S. Pat. No. 6,444,386, the disclosure of which is totally incorporated herein by reference, is a photoconductive imaging member comprised of an optional supporting substrate, a hole blocking layer thereover, a photogenerating layer, and a charge transport layer, and wherein the hole blocking layer is generated from crosslinking an organosilane (I) in the presence of a hydroxy-functionalized polymer (II)

(I)

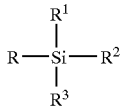

(II)

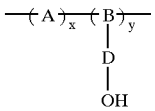

wherein R is alkyl or aryl, $R^1$, $R^2$, and $R^3$ are independently selected from the group consisting of alkoxy, aryloxy, acyloxy, halide, cyano, and amino; A and B are, respectively, divalent and trivalent repeating units of polymer (II); D is a divalent linkage; x and y represent the mole fractions of the repeating units of A and B, respectively, and wherein x is from about 0 to about 0.99, and y is from about 0.01 to about 1, and wherein the sum of x+y is equal to about 1.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer generated, for example, from the reaction of a silylfunctionalized hydroxyalkyl polymer of Formula (I) with an organosilane of Formula (II) and water (I)

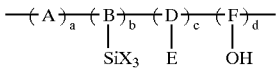

(II)

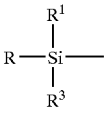

wherein, for example, A, B, D, and F represent the segments of the polymer backbone; E is an electron transporting moiety; Z is selected from the group consisting of chloride, bromide, iodide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl, with the substituent being halide, alkoxy, aryloxy, and amino; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in copending application U.S. Ser. No. 10/144,147, entitled Imaging Members, filed May 10, 2002, now U.S. Publication 2004/0211413, the disclosure of which is totally incorporated herein by reference, is a photoconductive imaging member comprised of a supporting substrate, and thereover a single layer comprised of a mixture of a photogenerator component, a charge transport component, an electron transport component, and a polymer binder and wherein the photogenerating component is a metal free phthalocyanine.

A number of photoconductive members and components thereof are illustrated in U.S. Pat. Nos. 4,988,597; 5,063,128; 5,063,125; 5,244,762; 5,612,157; 6,218,062; 6,200,716 and 6,261,729, the disclosures of which are totally incorporated herein by reference.

The appropriate components and processes of the above copending applications may be selected for the present invention in embodiments thereof.

BACKGROUND

This invention is generally directed to imaging members, and more specifically, the present invention is directed to multilayered photoconductive imaging members with a hole blocking layer comprised, for example, of a suitable hole blocking, or undercoat layer component of, for example, an electron transport component, such as n-butyl 9-dicyanomethylenefluorene-4-carboxylate (BCFM), 2-ethylhexyl 9-dicyanomethylenefluorene-4-carboxylate (2EHCFM), 9-dicyanomethylenefluorene-4-carboxylic acid (CFM), chemically grafted onto, for example, particles, such as titanium oxide, like $TiO_2$, tin oxide, zinc oxide, zinc sulfide, zirconium oxide and similar metal oxides and sulfides, and the like, and wherein the weight ratio of electron transport to the particles can vary, for example from about 1/1000 to about 30/100. The blocking layer enables, for example, additional pathways for electron transport thereby allowing excellent electron transport and low residual voltages, $V_r$; thicker hole blocking or undercoat layers, and which thicker layers permit excellent resistance to charge deficient spots, or undesirable plywood, and increase the layer coating robustness; acceptable cycling characteristics and environmental stability; and wherein honing of the supporting substrates is eliminated thus permitting, for example, the generation of economical imaging members. The hole blocking layer is preferably in contact with the supporting substrate and is preferably situated between the supporting substrate and the photogenerating layer comprised of photogenerating pigments, such as those illustrated in U.S. Pat. No. 5,482,811, the disclosure of which is totally incorporated herein by reference, especially Type V hydroxygallium phthalocyanine.

The imaging members of the present invention in embodiments exhibit excellent cyclic/environmental stability, and substantially no adverse changes in their performance over extended time periods since the imaging members can comprise a mechanically robust and solvent thick resistant hole blocking layer enabling the coating of a subsequent photogenerating layer thereon without structural damage, and which blocking layer can be easily coated on the supporting substrate by various coating techniques of, for example, dip or slot-coating. The aforementioned photoresponsive, or photoconductive imaging members can be negatively charged when the photogenerating layer is situated between the hole transport layer and the hole blocking layer deposited on the substrate.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

The use of perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyl-diimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882, the disclosure of which is totally incorporated herein by reference, photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder, as a hole transport layer. The above components, such as the photogenerating compounds, and the aryl amine charge transport can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

Also, of interest is Japanese Patent Publication 2,506,694 disclosing white pigment undercoat layers.

SUMMARY

It is a feature of the present invention to provide imaging members with many of the advantages illustrated herein, such as a thick hole blocking layer that prevents, or minimizes dark injection, and wherein the resulting photoconducting members possess, for example, excellent photoinduced discharge characteristics, cyclic and environmental stability and acceptable charge deficient spot levels arising from dark injection of charge carriers.

Another feature of the present invention relates to the provision of layered photoresponsive imaging members, which are responsive to near infrared radiation of from about 700 to about 900 nanometers.

It is yet another feature of the present invention to provide layered photoresponsive imaging members with a sensitivity to visible light, and which members possess improved coating characteristics, and wherein the charge transport molecules do not diffuse, or there is minimum diffusion thereof into the photogenerating layer.

Moreover, another feature of the present invention relates to the provision of layered photoresponsive imaging members with mechanically robust and solvent resistant hole blocking layers.

Aspects disclosed herein relate to a photoconductive imaging member comprised of a supporting substrate, a hole blocking layer thereover, a photogenerating layer, and a charge transport layer, and wherein the hole blocking layer is comprised of particles chemically attached on the surface of an electron transport component; a photoconductive imaging member comprised of a supporting component, a hole blocking layer thereover, a photogenerating layer, and a charge transport layer, and wherein the hole blocking layer is comprised of a component dispersed in polymeric binder, and wherein the component is chemically attached on the surface of an electron transport component; a photoconductor comprised of a hole blocking layer, a photogenerating layer, and a charge transport layer, and wherein the hole blocking layer is comprised of an electron transport component having attached thereto a metal oxide; a photoconductive imaging member comprised of a supporting substrate, a hole blocking layer thereover, a photogenerating layer and a charge transport layer, and wherein the hole blocking layer is comprised of, for example, a binder like a phenolic resin, and a metal oxide, such as a titanium oxide, that is chemically attached on the surface of an electron transport component of, for example, n-butyl 9-dicyanomethylenefluorene-4-carboxylate (BCFM), N,N'-disubstituted-1,4,5,8-naphthalenetetracarboxylic diimide, N,N'-disubstituted-1,7,8,13-perylenetetracarboxylic diimide, and the like; a photoconductive imaging member comprised of a substrate, a hole blocking layer thereover, a photogenerating layer, and a charge transport layer, and wherein the hole blocking layer is, for example, comprised of a particle dispersion of titanium oxide like $TiO_2$, a silicon oxide like $SiO_2$, and a suitable resin, and chemically attached thereto or grafted on the particle an electron transport component; an imaging member wherein the particle is grafted in an amount of from about 0.1 to about 30 weight percent; a member wherein the particle is, for example, titanium dioxide, and the polymer or resin binder, such as a phenolic resin, is present in an amount of from about 20 to about 80 weight percent of the hole blocking layer; a photoconductive device containing a particle grafted with electron transport components of BCFM, N,N'-disubstituted-1,4,5,8-naphthalenetetracarboxylic diimide; or N,N'-disubstituted-1,7,8,13-perylenetetracarboxylic diimide; a photoconductive imaging member wherein the hole blocking layer contains 3-aminopropyl trimethoxysilane, 3-aminopropyl triethoxysilane, or mixtures thereof; a photoconductive imaging member wherein the hole blocking layer is of a thickness of about 1 to about 30 microns, is of a thickness of about 3 to about 15 microns, or about 3 to about 8 microns; a photoconductive imaging member comprised in sequence of a supporting substrate, a hole blocking layer, an adhesive layer, a photogenerating layer and a charge transport layer; a photoconductive imaging member wherein the adhesive layer is comprised of a polyester with, for example, an $M_w$ of about 70,000, and an $M_n$ of about 35,000; a photoconductive imaging member wherein the supporting substrate is comprised of a conductive metal substrate; a photoconductive imaging member wherein the conductive substrate is aluminum, aluminized polyethylene terephthalate or titanized polyethylene; a photoconductive imaging member wherein the photogenerator layer is of a thickness of from about 0.05 to about 12 microns; a photoconductive imaging member wherein the charge, such as hole transport layer, is of a thickness of from about 10 to about 55 microns; a photoconductive imaging member wherein the photogenerating layer is comprised of photogenerating pigments selected in an amount of from about 10 percent by weight to about 95 percent by weight dispersed in a resinous binder; a photoconductive imaging member wherein the photogenerating resinous binder is selected from the group consisting of polyesters, polyvinyl butyrals, polycarbonates, polystyrene-b-polyvinyl pyridine, and polyvinyl formals; a photoconductive imaging member wherein the charge transport layers comprise aryl amine molecules, and other known charge, especially hole transports; a photoconductive imaging wherein the charge transport aryl amines are of the formula

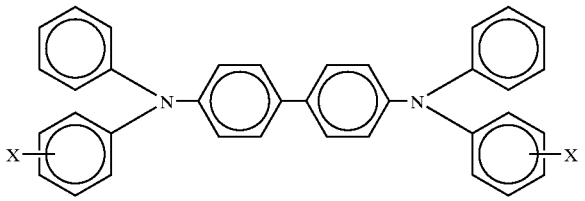

wherein X is alkyl, alkoxy, halide, and wherein the aryl amine is dispersed in a resinous binder; a photoconductive imaging member wherein for the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member wherein the photogenerating layer is comprised of metal phthalocyanines, metal free phthalocyanines, perylenes, hydroxygallium phthalocyanines, chlorogallium phthalocyanines, titanyl phthalocyanines, vanadyl phthalocyanines, selenium, selenium alloys, trigonal selenium, and the like; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine; and a method of imaging which comprises generating an electrostatic latent image on the imaging member illustrated herein, developing the latent image, and transferring the developed electrostatic image to a suitable substrate.

The hole blocking layers for the imaging members of the present invention contain particles that are chemically attached to the surface of an electron transport component where the electron transport component is selected, for example, from the group consisting of BCFM of the following formula, n-butyl 9-dicyanomethylenefluorene-4-carboxylate; BTNF of the following formula, n-butyl 4,5,7-trinitro-9-fluorenone-2-carboxylate; N-pentyl,N'-propylcarboxyl 1,4,5,8-naphthalenetetracarboxylic diimide (PPCNTDI) represented by the following formula

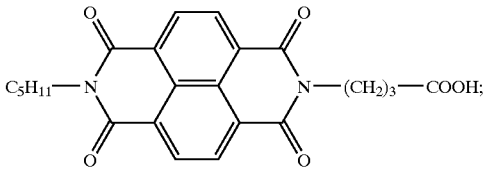

N-(1-methyl)hexyl,N'-propylcarboxyl-1,7,8,13-perylenetetracarboxylic diimide (1-MHPCPTDI) represented by the following formula

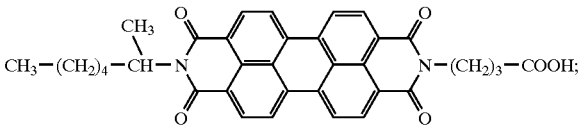

and a quinone selected, for example, from the group consisting of carboxybenzylnaphthaquinone (CBNQ) represented by the following formula

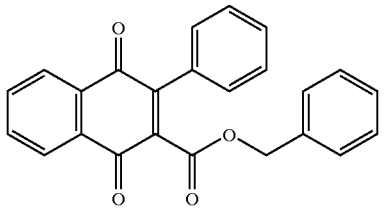

In embodiments the electron transport components can be chemically attached to metal oxides, such as $TiO_2$, with the formation of ester bonds. The following electron transport components, which generally possess functional carboxylic acid or carboxylate groups, may be selected for subsequent chemical attachment: carboxyfluorenone malononitrile (CFM) derivatives represented by

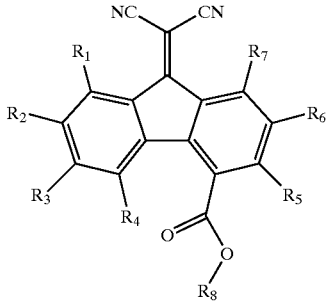

wherein each R is independently selected from the group consisting of hydrogen, alkyl having 1 to about 40 carbon atoms (for example is intended throughout with respect to the number of carbon atoms), alkoxy having 1 to about 40 carbon atoms, phenyl, substituted phenyl, higher aromatics, such as naphthalene and anthracene, alkylphenyl having about 6 to about 40 carbon atoms, alkoxyphenyl having about 6 to about 40 carbon atoms, aryl having about 6 to about 30 carbon atoms, substituted aryl having about 6 to about 30 carbon atoms, and halogen; or a nitrated fluorenone derivative represented by

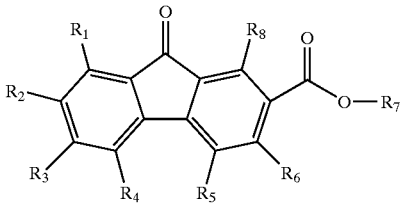

wherein each R is independently selected from the group consisting of hydrogen, alkyl, alkoxy, aryl, such as phenyl, substituted phenyl, higher aromatics, such as naphthalene and anthracene, alkylphenyl, alkoxyphenyl, carbons, substituted aryl and halogen, and wherein at least two R groups are nitro; a N,N'-disubstituted-1,4,5,8-naphthalenetetracarboxylic diimide represented by the general formula/structure

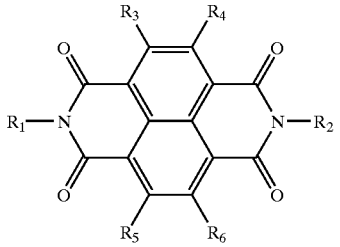

wherein $R_1$ is, for example, substituted or unsubstituted alkyl, branched alkyl, cycloalkyl, alkoxy or aryl, such as phenyl, naphthyl, a polycyclic aromatic, such as anthracene, wherein $R_1$ and $R_2$ are equivalent groups; $R_2$ is alkylcarboxylic acid or its ester derivatives, branched alkylcarboxylic acid or its ester derivatives, cycloalkylcarboxylic acid or its ester derivatives, arylcarboxylic acid or its ester derivatives, such as phenylcarboxylic acid or its ester derivatives, naphthylcarboxylic acid or its ester derivatives, or a polycyclic aromatic carboxylic acid or its ester derivatives, such as anthracenecarboxylic acid or its ester derivatives; and $R_1$ and $R_2$ can independently possess from 1 to about 50 carbon atoms, and more specifically, from 1 and about 12 carbon atoms. $R_3$, $R_4$, $R_5$ and $R_6$ are, for example, independently, alkyl, branched alkyl, cycloalkyl, alkoxy or aryl, such as phenyl, naphthyl, polycyclic aromatics, such as anthracene, or halogen and the like; a carboxybenzyl naphthaquinone electron transport represented by the following

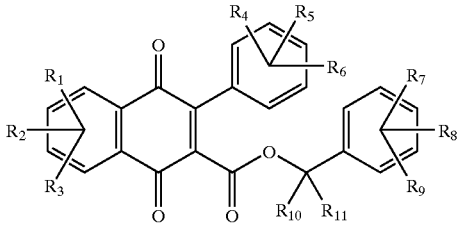

wherein each R is independently selected from the group consisting of hydrogen, alkyl with 1 to about 40 carbon atoms, alkoxy with 1 to about 40 carbon atoms, phenyl, substituted phenyl, higher aromatics, such as naphthalene and anthracene, alkylphenyl with about 6 to about 40 carbon atoms, alkoxyphenyl with about 6 to about 40 carbon atoms, aryl with about 6 to about 30 carbon atoms, substituted aryl with about 6 to about 30 carbon atoms, and halogen; and electron transport component mixtures thereof wherein the mixtures can contain from 1 to about 99 weight percent of one electron transport component and from about 99 to about 1 weight percent of a second or more electron transport components, and which electron transport components can be grafted onto particles, such as $TiO_2$, and wherein the total amount of electron transport components thereof is about 100 percent. Examples of the particles grafted onto with, for example, a diameter size of from about 20 nanometers to about 10 microns, and preferably from about 50 nanometers to about 1 micron are the metal oxides illustrated here, such as a titanium oxide, optionally doped with carbon, nitrogen, and wherein the titanium dioxide that is chemically attached on the surface of BCFM can be represented by the formula

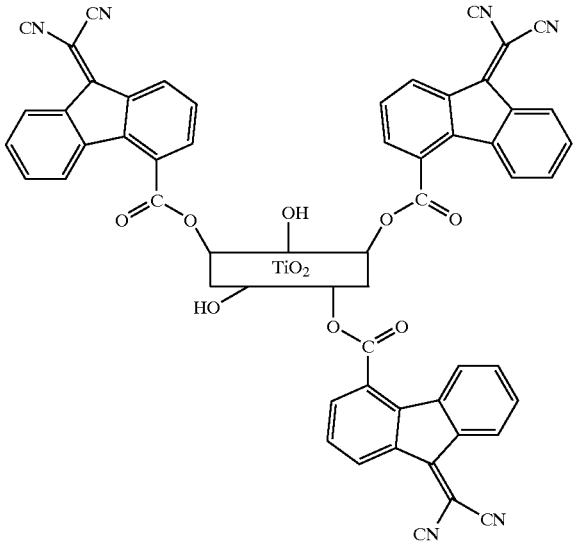

The metal oxides can be chemically attached on the surface of the electron transport component, and wherein ester bonds can form directly from the esterification reaction between the hydroxyl groups present on the metal oxide surface and the carboxylic acid group of the electron transport component, such as CFM, PPCNTDI, 1-MHPCPTDI, under thermal activation. When the electron transport component possesses a functional carboxylate group, such as BCFM, BTNF, CBNQ, the surface of the metal oxide is usually activated with a basic catalyst, such as lithium tert-butoxide, and then the esterification reaction is accomplished between the activated metal oxide, such as, for example, $M_xO_y^-Li^+$ where M is a metal atom, and the electron transport component. Generally, the activation reaction involves the mixing of the basic catalyst with a metal oxide at room temperatures. The linkage between the electron transport component and metal oxide is, however, not limited to an ester bond, and other spacers can be inserted therebetween such as, for example, aminosilanes such as 3-aminopropyl trimethoxysilane. Generally, the amino group of the spacer can react with the carboxylate group of the electron transport component and an amide bond is formed, while the silane moiety of the spacer can chemically attach to the metal oxide and a Si—O—M (M is the metal atom) linkage is formed.

The hole blocking layer can in embodiments be prepared by a number of known methods, the process parameters being dependent, for example, on the member desired. The hole blocking layer can be coated as solutions or dispersions onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow. The coating can be accomplished to provide a final coating thickness of from about 1 to about 30 microns, preferably from about 3 to about 15 microns after drying.

Illustrative examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®. Moreover, the substrate may contain thereover an undercoat layer, including known undercoat layers, such as suitable phenolic resins, phenolic compounds, mixtures of phenolic resins and phenolic compounds, titanium oxide, silicon oxide mixtures like $TiO_2/SiO_2$, the components of copending application U.S. Ser. No. 10/144,147, filed May 10, 2002, the disclosure of which is totally incorporated herein by reference, and the like.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

The photogenerating layer, which can be comprised of the components indicated herein, such as hydroxychlorogallium phthalocyanine, is in embodiments comprised of, for example, about 50 weight percent of the hyroxygallium or other suitable photogenerating pigment, and about 50 weight percent of a resin binder like polystyrene/polyvinylpyridine. The photogenerating layer can contain known photogenerating pigments, such as metal phthalocyanines, metal free phthalocyanines, hydroxygallium phthalocyanines, perylenes, especially bis(benzimidazo)perylene, titanyl phthalocyanines, and the like, and more specifically, vanadyl phthalocyanines, Type V chlorohydroxygallium phthalocyanines, and inorganic components, such as selenium, especially trigonal selenium. The photogenerating pigment can be dispersed in a resin binder similar to the resin binders selected for the charge transport layer, or alternatively no resin binder is needed. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 15 microns, and more specifically, from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. It is desirable to select a coating solvent that does not substantially disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 3 microns, and more specifically, about 1 micron. Optionally, this layer may contain effective suitable amounts, for example from about 1 to about 10 weight percent, conductive and nonconductive particles, such as zinc oxide, titanium dioxide, silicon nitride, carbon black, and the like, to provide, for example, in embodiments of the present invention further desirable electrical and optical properties.

Various suitable know charge transport compounds, molecules and the like can be selected for the charge transport layer, such as aryl amines of the following formula

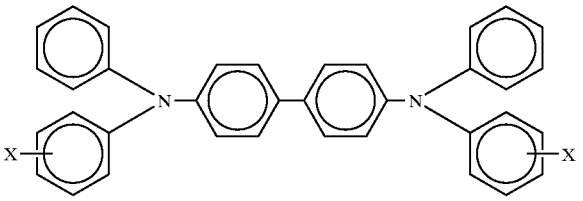

and wherein the thickness thereof is, for example, from about 5 microns to about 75 microns, or from about 10 microns to about 40 microns dispersed in a polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of binder materials selected for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies, and block, random or alternating copolymers thereof. A specific electrically inactive binder is comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of the binder material.

The blocking layer can also contain suitable binders as illustrated herein, and more specifically, phenolic resins such as formaldehyde polymers with phenol, p-tert-butylphenol, cresol, such as VARCUM™ 29159 and 29101 (OxyChem Company) and DURITE™ 97 (Borden Chemical), formaldehyde polymers with ammonia, cresol and phenol, such as VARCUM™ 29112 (OxyChem Company), formaldehyde polymers with 4,4'-(1-methylethylidene) bisphenol, such as VARCUM™ 29108 and 29116 (OxyChem Company), formaldehyde polymers with cresol and phenol, such as VARCUM™ 29457 (OxyChem Company), DURITE™ SD-423A, SD-422A (Borden Chemical), or formaldehyde polymers with phenol and p-tert-butylphenol, such as DURITE™ ESD 556C (Borden Chemical). In embodiments the weight ratio of the particles that are chemically attached to the surface of an electron transport component and the polymeric binder varies, for example, from about 20/80 to about 80/20, preferably from about 40/60 to about 70/30, or wherein, for example, the weight ratio of the electron transport component and the metal oxide varies from about 1/1000 to about 30/100 and preferably from about 1/100 to about 10/100.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE

Preparation of ETM-grafted Metal Oxides that are Chemically Attached on the Surface of an Electron Transport Component:

(1) BCFM-grafted $TiO_2$

Ten milliliters of lithium tert-butoxide (1M in hexane) were injected into a 1,000 milliliter flask by a syringe under an argon gas flow. Then 100 grams of dried (dried at 120° C. for 3 days) titanium dioxide (STN-60, Sakai) was added into the flask with 500 milliliters of hexane. The suspension was stirred vigorously at room temperature, about 22° C. to about 25° C., for 3 days, and was filtrated quickly. The white powder resulting was dried at 40° C. under reduced pressure (350 millimeters Hg) for 2 hours. The activated titanium dioxide obtained was recharged into the flask with 3.28 grams of n-butyl 9-dicyanomethylenefluorene-4-carboxylate (BCFM) and 300 milliliters of methylene chloride. Under an argon gas flow, the mixture was stirred at room temperature for 24 hours. Then the mixture was filtrated, and washed by 3×100 milliliters of methylene chloride and 3×150 milliliters of methanol. Thereafter, the resulting slightly yellowish powder was mixed with 1,000 milliliters of water with vigorous stirring for 1 hour, and filtrated. Finally, the powder was dried at 80° C. under reduced pressure (350 millimeters Hg) for 24 hours. The resulting BCFM-grafted $TiO_2$ product was of a yellowish color. The attachment of BCFM onto $TiO_2$ was confirmed with FTIR, and the weight ratio of BCFM/$TiO_2$ was estimated to be about 3/100 with element analysis.

(2) 1-MHPCPTDI-grafted ZnO

One hundred grams of zinc oxide (SMZ-017N, Tayca) and 1 gram of N-(1-methyl)hexyl,N'-propylcarboxyl-1,7,8,13-perylenetetra carboxylic diimide (1-MHPCPTDI) were added to 500 grams of tetrahydrofuran (THF) and ultrasonicated for 30 minutes. The dispersion obtained was then stirred and heated to 50° C. for 12 hours. Afterwards, THF was evaporated, and the solid was dried at 80° C. for 12 hours. The resulting 1-MHPCPTDI-grafted ZnO was a dark red pigment. The attachment of 1-MHPCPTDI onto ZnO was confirmed with FTIR, and the weight ratio of 1-MHPCPTDI/ZnO was estimated as being about 1/100 with element analysis.

For photoconductive members, two $TiO_2$ nanoparticles were used, untreated $TiO_2$ (STR-60N, Sakai) and BCFM-grafted $TiO_2$ (described as above), respectively. Thirty grams of $TiO_2$, 40 grams of VARCUM™ 29159 (50 percent solid in butanol/xylene=50/50, OxyChem) and 30 grams of butanol/xylene=50/50 were mixed; 300 grams of cleaned $ZrO_2$ beads (0.4 to 0.6 millimeter) were then added, and the dispersion was roll milled for 7 days at 55 rpm. The particle size of the dispersion was determined by a Horiba particle analyzer. The results were 0.07±0.06 $\mu$m and a surface area of 24.9 $m^2/g$ for the BCFM-grafted $TiO_2$/VARCUM™ dispersion, and 0.06±0.13 $\mu$m and a surface area of 26.1 $m^2/g$ for the untreated $TiO_2$/VARCUM™ dispersion.

Two 30 millimeter aluminum drum substrates were coated using the known Tsukiage coating process with a hole blocking layer from the above two dispersions, untreated $TiO_2$/VARCUM™ and BCFM-grafted $TiO_2$/VARCUM™. After drying at 145° C. for 45 minutes, blocking layers or undercoat layers (UCL) with varying thicknesses were obtained by controlling pull rates. For untreated $TiO_2$/VARCUM™ UCL, the thickness can vary from 3.9, 6.1 and 9.4 microns; for the BCFM-grafted $TiO_2$/VARCUM UCL, the thickness can vary from 3.9, 6 and 9.6 microns. A 0.2 micron photogenerating layer was subsequently coated on top of each of the hole blocking layers from a dispersion of chlorogallium phthalocyanine (0.60 gram) and a binder of polyvinyl chloride-vinyl acetate-maleic acid terpolymer (0.40 gram) in 20 grams of a 1:2 mixture of n-butyl acetate/xylene solvent. Subsequently, a 22 micron charge transport layer (CTL) was coated on top of the photogenerating layer from a solution of N,N'-diphenyl-N,N-bis(3-methyl phenyl)-1,1'-biphenyl-4,4'-diamine (8.8 grams) and a polycarbonate, PCZ-400 [poly(4,4'-dihydroxy-diphenyl-1-1-cyclohexane, $M_w$=40,000)] available from Mitsubishi Gas Chemical Company, Ltd. (13.2 grams) in a mixture of 55 grams of tetrahydrofuran (THF) and 23.5 grams of toluene. The CTL was dried at 120° C. for 45 minutes.

The xerographic electrical properties of the imaging members can be determined by known means including, as indicated herein, electrostatically charging the surfaces thereof with a corona discharge source until the surface potentials, as measured by a capacitively coupled probe attached to an electrometer, attained an initial value $V_o$ of about −500 volts. Each member was then exposed to light from a 670 nanometer laser with >100 ergs/$cm^2$ exposure energy, thereby inducing a photodischarge which resulted in a reduction of surface potential to a $V_r$ value, residual potential. The following table summarizes the electrical performance of these devices, and which table data illustrates the electron transport enhancement of illustrative photoconductive members of the present invention. Specifically, while the primary transport in the layer occurs through the $TiO_2$, additional pathways for electron transport are enabled by the inclusion of the specific electron transport component that is chemically grafted onto $TiO_2$ illustrated herein. The enhancement in electron mobility was demonstrated by the decrease in $V_r$ with the same UCL thickness. These parameters indicate that a greater amount of charge was moved out of the photoreceptor, resulting in a lower residual potential for the photoconductor containing the chemically grafter component.

| | UCL THICKNESS | VR (V) |
|---|---|---|
| BCFM-g-$TiO_2$/VARCUM ™ UCL | 3.9 microns | 33 |
| | 6.0 microns | 57 |
| | 9.6 microns | 118 |
| $TiO_2$/VARCUM ™ UCL | 3.9 microns | 42 |
| | 6.1 microns | 79 |
| | 9.4 microns | 174 |

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A photoconductive imaging member comprised of a supporting substrate, a hole blocking layer thereover, a photogenerating layer, and a charge transport layer, and wherein the hole blocking layer is comprised of particles chemically attached on the surface of an electron transport component.

2. An imaging member in accordance with claim 1 wherein said particles are $TiO_2$.

3. An imaging member in accordance with claim 1 wherein said particles are an oxide of tin, zinc, silicon or zirconium.

4. An imaging member in accordance with claim 1 wherein said particle are present in an amount of from about 70 to about 99.9 weight percent.

5. An imaging member in accordance with claim 1 wherein said electron transport component is present in an amount of from about 0.1 to about 30 weight percent.

6. An imaging member in accordance with claim 1 wherein said hole blocking layer is dispersed in a resin binder.

7. An imaging member in accordance with claim 1 wherein said electron transport component is n-butyl 9-dicyanomethylenefluorene-4-carboxylate (BCFM).

8. An imaging member in accordance with claim 1 wherein said electron transport component is n-butyl 4,5,7-trinitro-9-fluorenone-2-carboxylate (BTNF).

9. An imaging member in accordance with claim 1 wherein said electron transport component is N-pentyl,N'-propylcarboxyl-1,4,5,8-naphthalenetetracarboxylic diimide (PPCNTDI).

10. An imaging member in accordance with claim 1 wherein said electron transport component is N-(1-methyl) hexyl,N'-propylcarboxyl-1,7,8,13-perylenetetracarboxylic diimide (1-MHPCPTDI).

11. An imaging member in accordance with claim 1 wherein said electron transport component is carboxybenzyl naphthaquinone.

12. An imaging member in accordance with claim 1 wherein said electron transport component is selected in an amount of from about 0.5 to about 20 weight percent, and wherein chemically attached is by grafting.

13. An imaging member in accordance with claim 1 wherein said electron transport component is selected in an amount of from about 1 to about 10 weight percent, and wherein said chemically attached is by grafting.

14. An imaging member in accordance with claim 1 wherein said hole blocking layer is of a thickness of about 2 to about 15 microns.

15. An imaging member in accordance with claim 1 comprised in the following sequence of said supporting substrate, said hole blocking layer, an adhesive layer, said photogenerating layer, and said charge transport layer, and wherein said charge transport layer is a hole transport layer.

16. An imaging member in accordance with claim 15 wherein the adhesive layer is comprised of a polyester with an $M_w$ at from about 45,000 to about 75,000, and an $M_n$ of from about 25,000 to about 40,000.

17. An imaging member in accordance with claim 1 wherein the supporting substrate is comprised of a conductive metal substrate, and optionally which substrate is aluminum, aluminized polyethylene terephthalate, or titanized polyethylene terephthalate.

18. An imaging member in accordance with claim 1 wherein said photogenerator layer is of a thickness of from about 0.05 to about 10 microns, and wherein said transport layer is of a thickness of from about 10 to about 50 microns.

19. An imaging member in accordance with claim 1 wherein the photogenerating layer is comprised of photogenerating pigments dispersed in a resinous binder in an optional amount of from about 5 percent by weight to about 95 percent by weight, and optionally wherein the resinous binder is selected from the group consisting of polyesters, polyvinyl butyrals, polycarbonates, polystyrene-b-polyvinyl pyridines, and polyvinyl formals.

20. An imaging member in accordance with claim 1 wherein the charge transport layer comprises aryl amines, and which aryl amines are of the formula

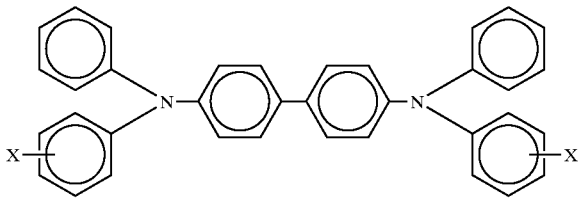

wherein X is selected from the group consisting of alkyl and halogen.

21. An imaging member in accordance with claim 20 wherein alkyl contains from about 1 to about 10 carbon atoms, or wherein alkyl contains from 1 to about 5 carbon atoms, or optionally wherein alkyl is methyl, wherein halogen is chloride, and wherein there is further included a resinous binder selected from the group consisting of polycarbonates and polystyrenes.

22. An imaging member in accordance with claim 20 wherein the aryl amine is N,N'-diphenyl-N,N-bis(3-methyl phenyl)-1,1'-biphenyl-4,4'-diamine.

23. An imaging member in accordance with claim 1 wherein the photogenerating layer is comprised of metal phthalocyanines, hydroxygallium phthalocyanines, chlorogallium phthalocyanines, or metal free phthalocyanines.

24. An imaging member in accordance with claim 1 wherein the photogenerating layer is comprised of titanyl phthalocyanines, perylenes, or halogallium phthalocyanines.

25. An imaging member in accordance with claim 1 wherein the photogenerating layer is comprised of chlorogallium phthalocyanines.

26. A method of imaging which comprises generating an electrostatic latent image on the imaging member of claim 1, developing the latent image, and transferring the developed electrostatic image to a suitable substrate.

27. A photoconductive imaging member comprised of a supporting component, a hole blocking layer thereover, a photogenerating layer, and a charge transport layer, and wherein the hole blocking layer is comprised of a component dispersed in polymeric binder, and said component is chemically attached on the surface of an electron transport component.

28. A photoconductor comprised of a hole blocking layer, a photogenerating layer, and a charge transport layer, and wherein said hole blocking layer is comprised of an electron transport component having attached thereto a metal oxide.

29. A xerographic device comprised of a charging component, a photoconductive component, a transfer component, a development component, and fusing component; and wherein the photoconductor component is comprised of a supporting substrate, a hole blocking layer thereover, a photogenerating layer, and a charge transport layer, and wherein the hole blocking layer is comprised of particles chemically attached on the surface of an electron transport component.

* * * * *